US007451671B2

(12) United States Patent
Coleman, Jr.

(10) Patent No.: US 7,451,671 B2
(45) Date of Patent: Nov. 18, 2008

(54) PORTA JACK FOR FLOORING

(75) Inventor: Jerry D. Coleman, Jr., Wilmington, NC (US)

(73) Assignee: Porta-Nails, Inc., Wilmington, NC (US)

( * ) Notice: Subject to any disclaimer, the term of this patent is extended or adjusted under 35 U.S.C. 154(b) by 0 days.

(21) Appl. No.: 11/728,364

(22) Filed: Mar. 26, 2007

(65) Prior Publication Data

US 2008/0236093 A1 Oct. 2, 2008

(51) Int. Cl.
*E04F 21/22* (2006.01)
*B66F 3/02* (2006.01)

(52) U.S. Cl. ..... 81/46; 254/12

(58) Field of Classification Search ..... 81/46; 254/11–16, 112, 118
See application file for complete search history.

(56) References Cited

U.S. PATENT DOCUMENTS 964,305 A * 7/1910 Oliver ..... 254/12
1,094,449 A * 4/1914 Lauri ..... 254/13
1,145,160 A * 7/1915 Meadows ..... 254/14
1,210,277 A * 12/1916 Culp ..... 254/12
1,447,720 A * 3/1923 Hall ..... 254/12
1,569,346 A * 1/1926 Wilson et al. ..... 254/16
1,577,491 A * 3/1926 Prentice ..... 254/11
2,489,990 A * 11/1949 Treaster ..... 254/12
2,708,097 A * 5/1955 Hinger ..... 254/12
2,933,288 A * 4/1960 Sholick ..... 254/12

* cited by examiner

*Primary Examiner*—David B Thomas
(74) *Attorney, Agent, or Firm*—Ralph H. Dougherty

(57) ABSTRACT

An improved method and apparatus for urging a flooring strip into close or tight engagement with the adjacent flooring strip, which has already been fixed into position, and holding the flooring strip securely in position for nailing or otherwise fixing the flooring strip. The invented device has a base plate with having holes therein for attachment to a floor (subfloor), a rack and pinion gear arrangement where the rack has an angle iron style pusher-puller ram pusher at the end of the rack, the end of the base plate having a removable shoe, and a rack housing situated on the base plate with an associated pinion gear engaging the rack and operated by a levering handle for urging the flooring strip into position for installation.

8 Claims, 5 Drawing Sheets

PORTA JACK FOR FLOORING

FIELD OF THE INVENTION

The present invention relates to an apparatus for installing flooring, especially having tongue and groove joints, and parquet flooring, and more particularly to apparatus and methods for placing individual flooring members tightly and accurately in position for nailing into place.

BACKGROUND OF THE INVENTION

Flooring elements are normally elongated boards with a tongue in one edge and a mating groove in the opposing edge. The ends of the flooring element may also be similarly configured. Wooden strip flooring is often slightly crooked or warped, or may be curved or bent, requiring the installer to drive the strip into engagement with the adjacent strip using a hammer, mallet, or seating tool. Unless pressure is maintained on the strip during the nailing of the strip into the proper position, the strip can move, resulting in a small gap between strips with the final floor being uneven, which could require its replacement because of the poor installation or for aesthetic reasons.

Many devices have been developed to overcome this problem. However, flooring jacks currently available work only in a single direction, either by pushing a flooring strip into place with regard to a wall or other fixed building element, or by pushing a flooring strip into place by anchoring the pushing device into place before bearing on the strip. There is no suitable device that will operate in either direction, as desired by the installer.

PRIOR ART

Applicant is aware of a number of U.S. Patents and published U.S. Applications concerning devices for holding flooring elements in the proper position for nailing. However, none of the devices described in the references located are capable of both pushing or pulling the flooring strip into position for fixing it into place. The invented apparatus has the full capability of operating in both manners, as desired.

SUMMARY OF THE INVENTION

The invention provides apparatus for urging a flooring strip into close or tight engagement with an adjacent flooring strip, which has already been fixed into position, and holding the flooring strip securely in position for fastening.

The invented device, known as Portajack, has a base plate having holes therein for attachment to a floor (subfloor) or a joist, a rack and pinion gear arrangement where the rack has an angle iron style ram or pusher at the end of the rack, the end of the base plate having a removable pushing shoe, and a rack housing situated on the base plate with an associated ratcheting pinion gear engaging the rack and operated by a levering handle for urging the flooring strip into position for installation.

During normal operation, with the removable shoe removed, a first straight flooring strip is installed, then a second strip is positioned for installation, the Portajack is positioned with the pusher against the second strip, and positioned and attached to the subflooring or joist by installing wood screws through the holes provided in the base, into the sub-floor, then the second strip is urged against the prior strip by ratcheting action of the rack and pinion gear, and is held in tight proximity to the prior strip while it is fastened into place.

With the shoe installed, the invented device works in the opposite direction. The device is positioned with the pusher against a wall or other suitable supporting surface. The pulling (pushing) shoe is positioned against a flooring strip that has been positioned for installation. Then the flooring strip is moved into tight proximity against the prior strip by ratcheting action of the rack and pinion gear. A piece of wood or other suitable material may be attached to the pusher to serve as a soft surface or to enhance the width, height, or depth of the pusher, by installing wood screws through the holes provided in the pusher into a properly aligned piece of wood.

The present invention is particularly useful for installing floors and decks having flooring strips, as well as for installing parquet style flooring and panel-type flooring.

OBJECTS OF THE INVENTION

The principal object of the present invention is to provide an improved method of installing wooden flooring.

A further object of this invention is to provide a method of urging curved, bent, warped, or crooked flooring strips into engagement with adjacent strips.

Another object of the invention is to provide apparatus for installing a flooring strip which is capable of both pushing and pulling the strip into position for nailing.

BRIEF DESCRIPTION OF THE DRAWINGS

The foregoing and other objects will become more readily apparent by referring to the following detailed description and the appended drawings in which.

DETAILED DESCRIPTION

Figure 1:
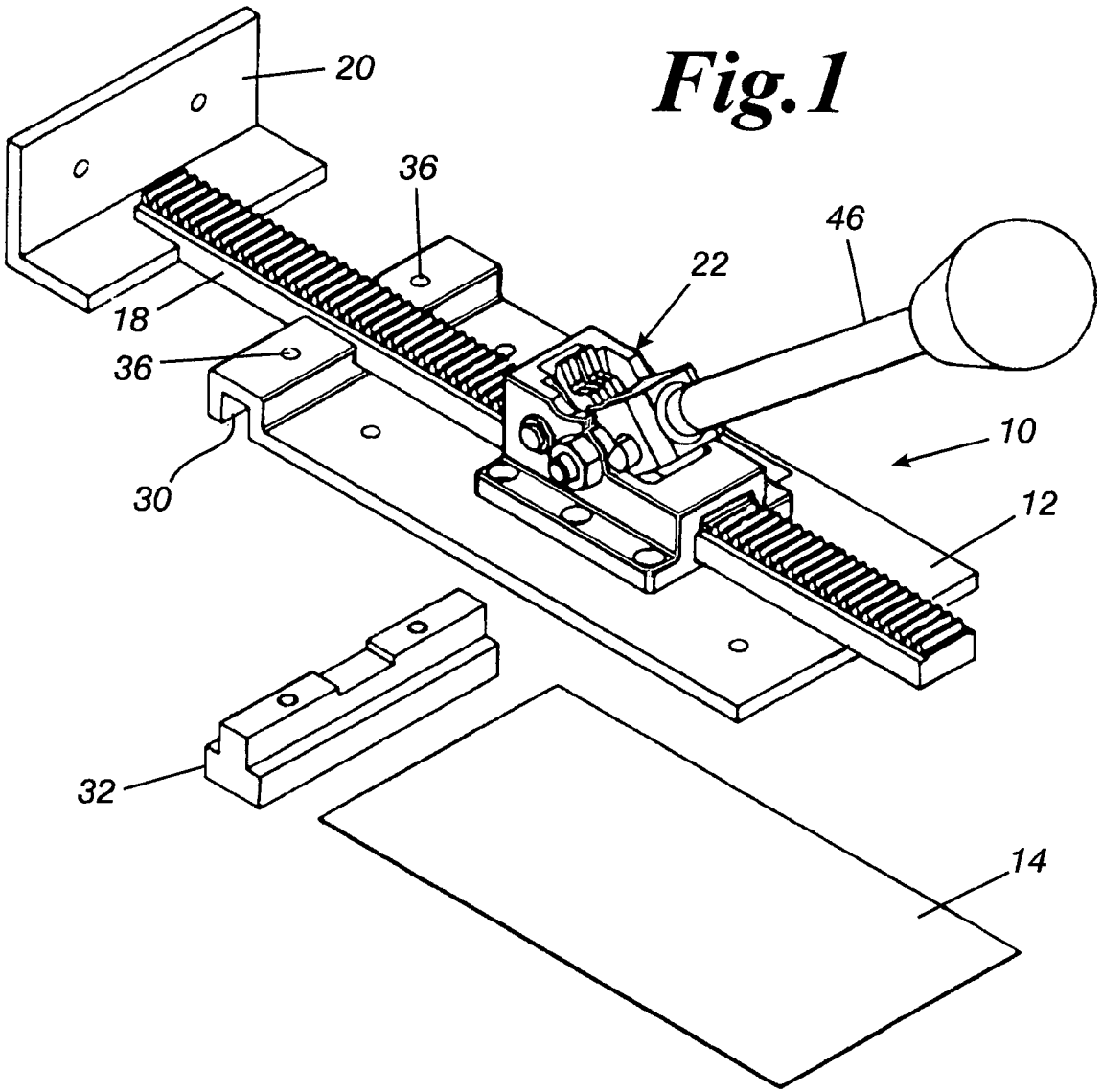
FIG. 1 is a partially exploded, left hand isometric view of a preferred embodiment of the Portajack invention.
Figure 2:
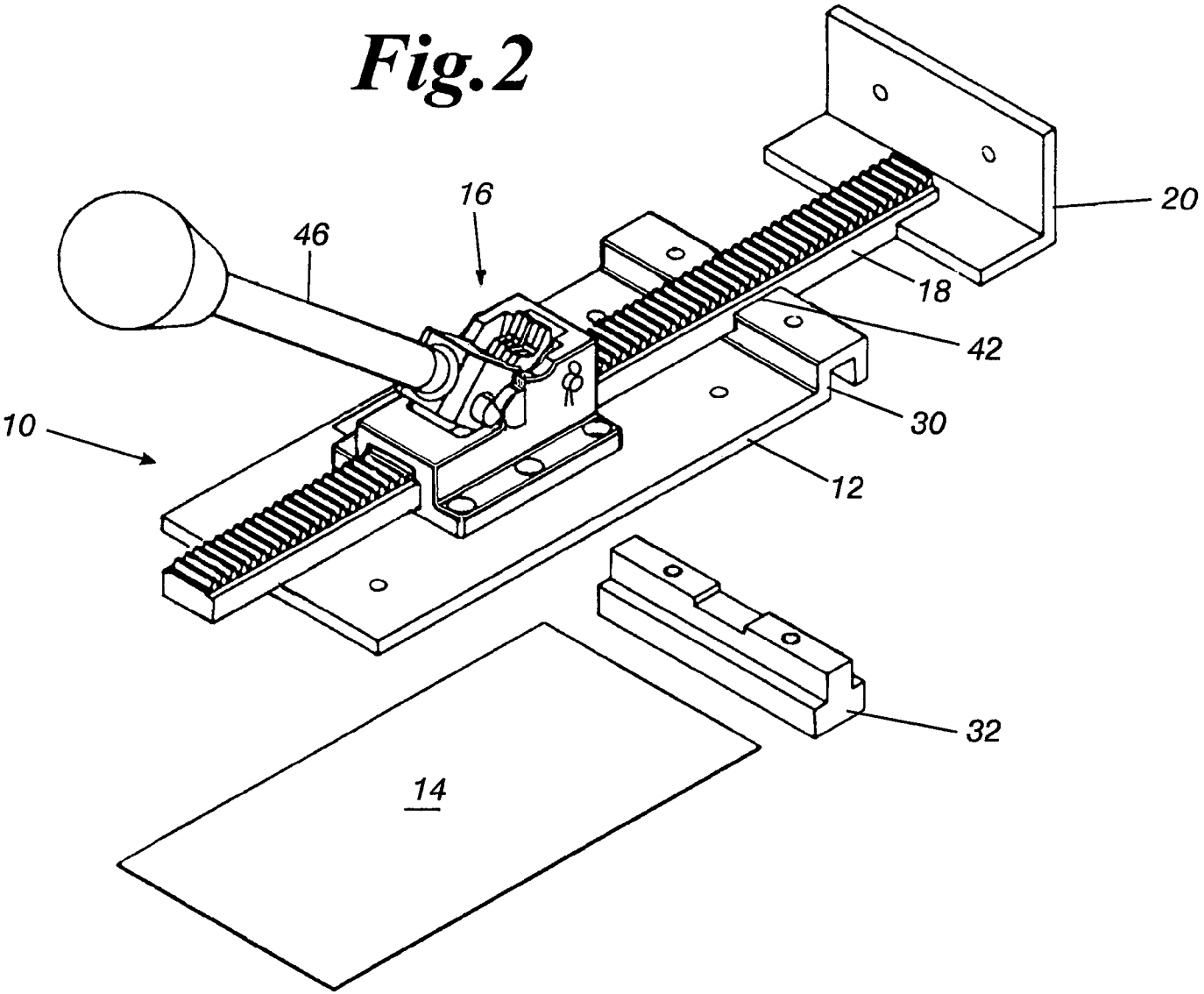
FIG. 2 is a partially exploded, right hand isometric view of a the preferred embodiment of the Portajack invention shown in FIG. 1.
Figures 3, 4:
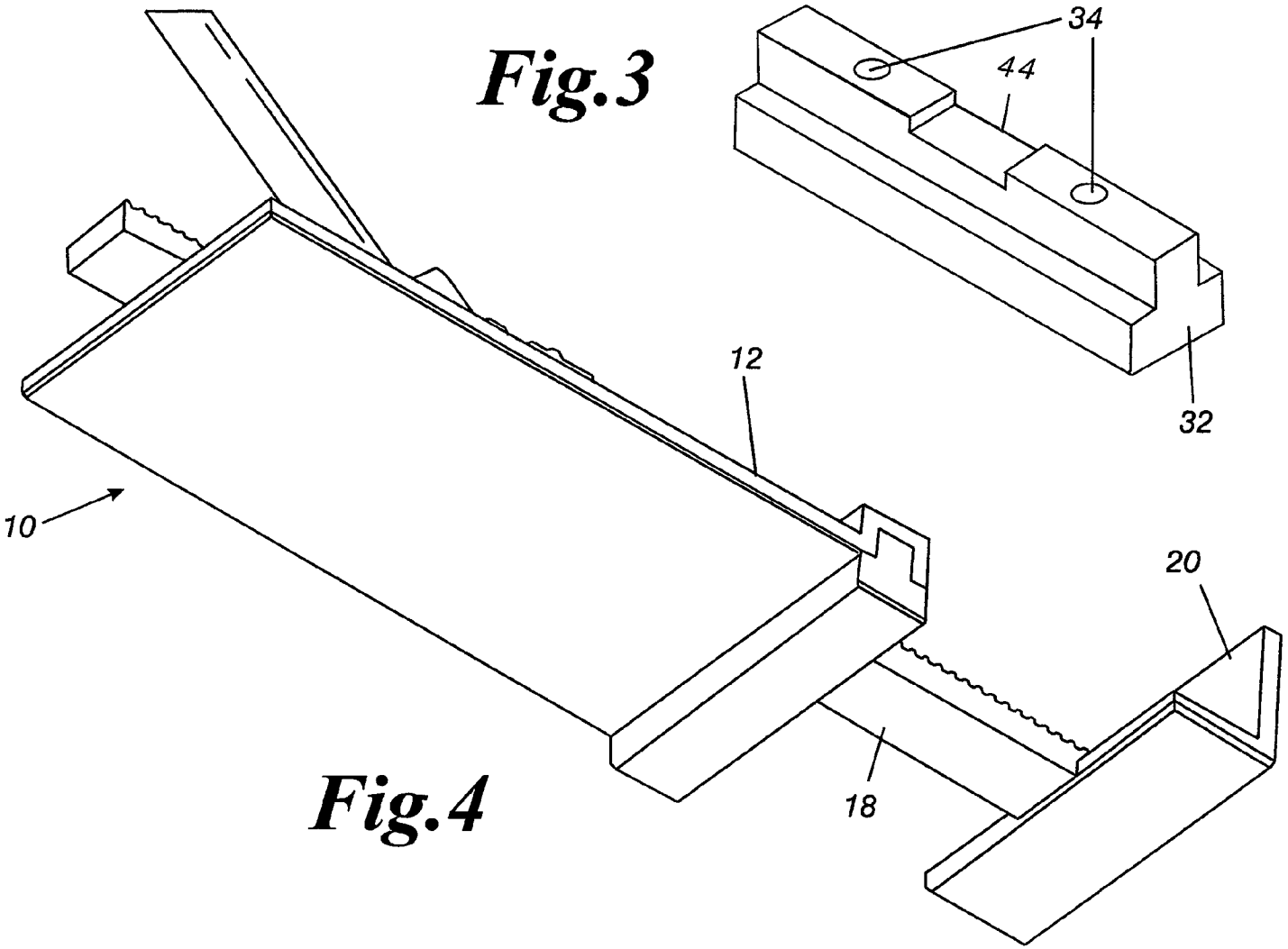
FIG. 3 is an isometric view of the removable shoe of the Portajack.
FIG. 4 is an isometric bottom view of the Portajack with the removable shoe installed therein.

Referring now to the drawings, and particularly to FIG. 1, the invented flooring jack device 10 includes a flat base 12 on which a pad 14 may be installed. Atop and fixed to the base is a rack and pinion gear 16 comprising a rack 18 having a ram pusher 20 affixed to the end of the rack, a gear housing 22 in which is located a standard pinion gear and rachet arrangement for moving the rack through the gear housing.

The base advantageously is provided with a downwardly opening groove, slot, or recess 30, to accommodate a removable shoe 32. The shoe is retained in the groove by any convenient means. Holes 34 may be tapped in the shoe to receive machine screws through mating holes 36 in the base. Alternatively, a tongue and groove arrangement may be employed, or even horizontal mating holes may provided through the groove housing portion of the base and the shoe to receive screws, bolts, cotter pins, or other retainer. The shoe could be attached directly to the flat plate, but preferably the base plate is provided with a recess as shown for receiving and retaining the shoe.

Figure 5:
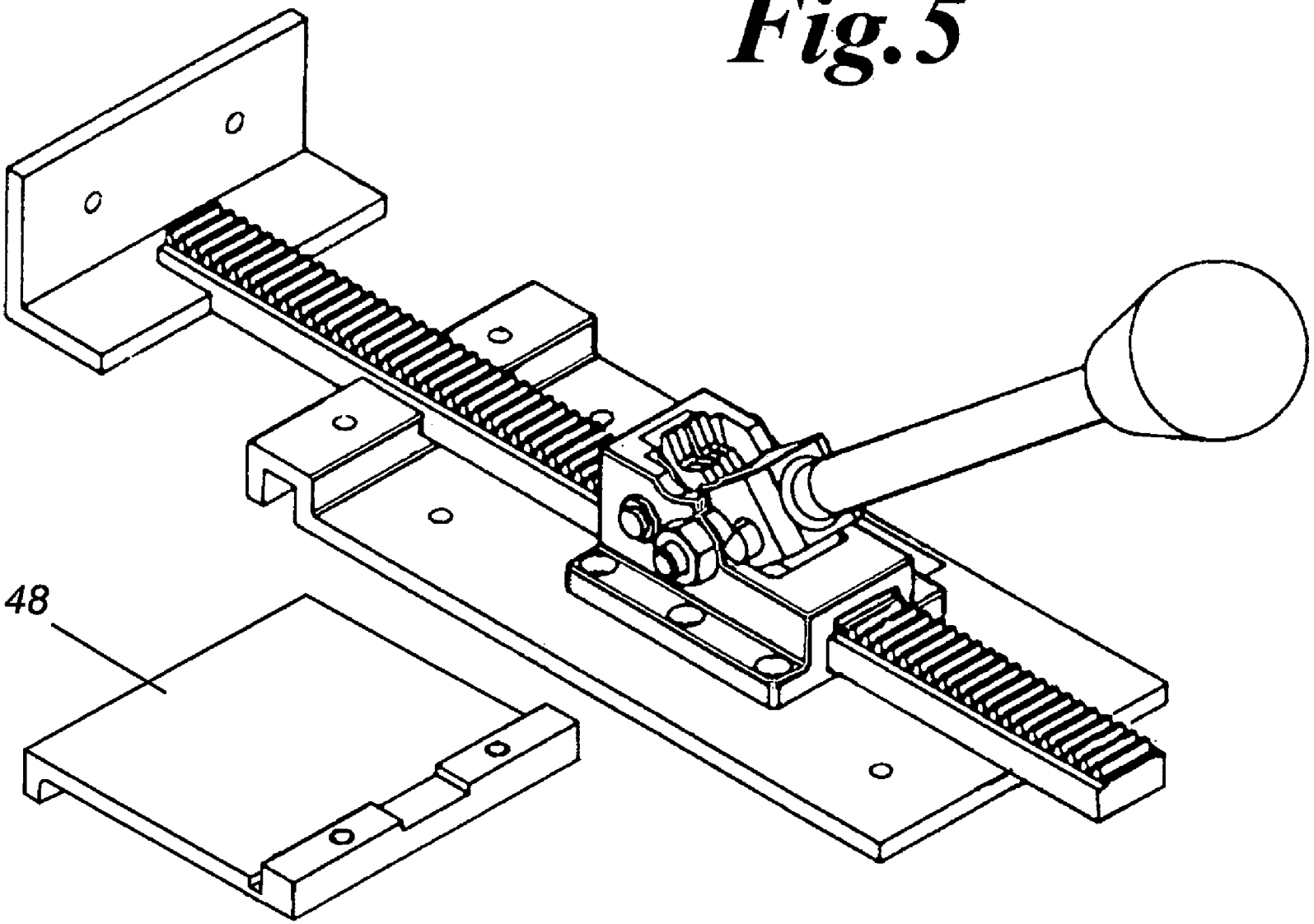
FIG. 5 is an isometric view of the invented Portajack having an alternative removable shoe, in the removed position.
Figure 6:
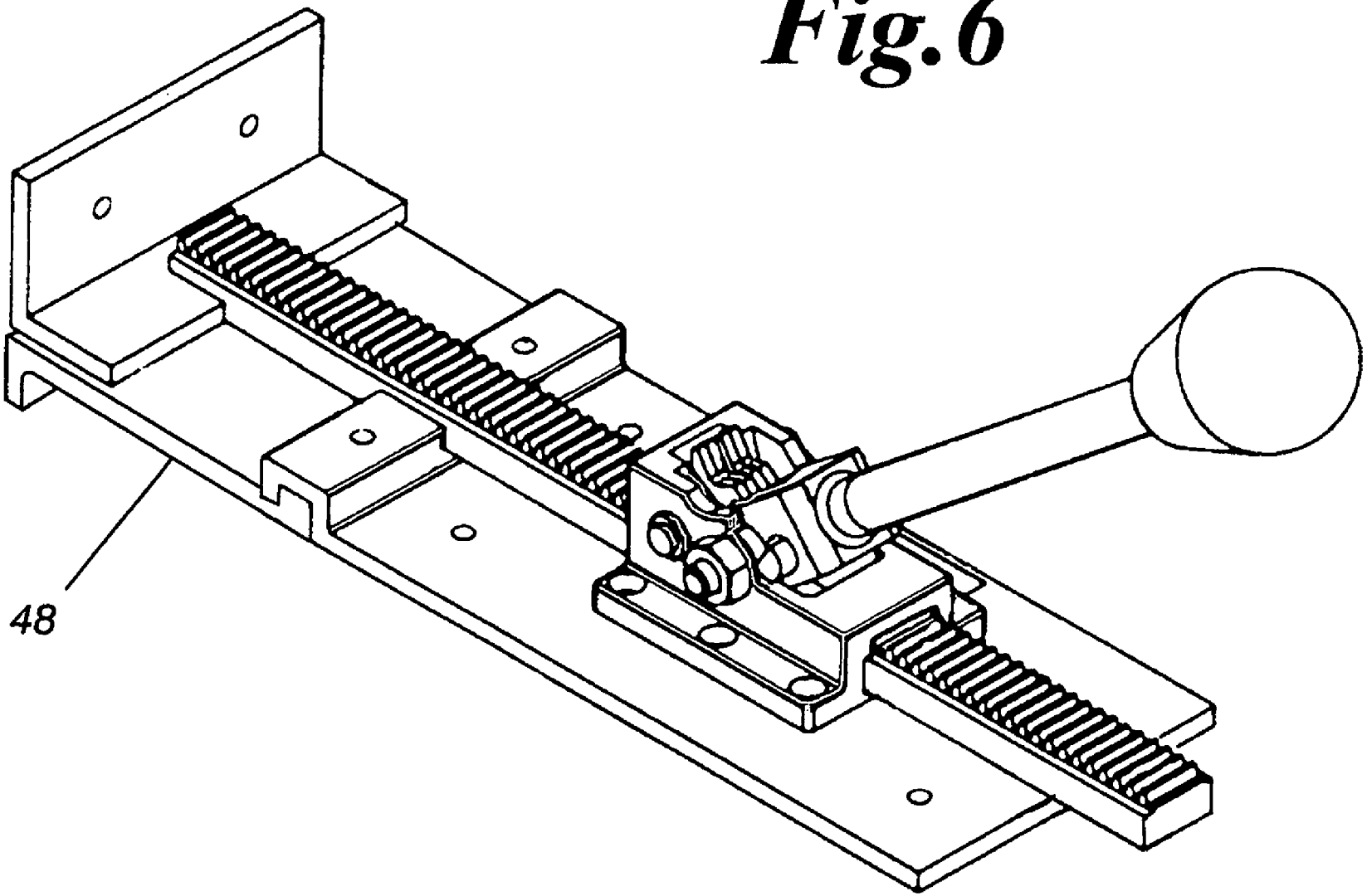
FIG. 6 is an isometric view of the Portajack of FIG. 5 with the alternative removable shoe installed thereon.

An alternative removable shoe 48, shown in FIGS. 5 and 6, has a Z-shaped cross-section, and is adapted to extend farther from the end of the base toward the ram pusher than the removable shoe 32. The alternative shoe 48 is removably attached to the base in the same manner as shoe 32.

The end of the base 12 nearer the ram pusher 20 may be provided with a gap 42 to allow the rack to move easily therethrough. The shoe 32 or 48 can also be provided with a mating gap 44 for the same purpose, if desired.

An operating handle 46 is provided to move the rack and urge the ram pusher 20 or the removable shoe in the desired direction of operation.

The ram pusher 20 is advantageously provided with means for attaching an extension thereto for spreading the load to be applied upon activation of the rack and pinion gear. Holes are shown for attaching a fence or cushioning member, which member should be at least as long as the spacing of wall studs, that is, usually at least in excess of 16 inches, which is the standard distance between studs, although in some types of construction, this measurement may be greater or smaller due to differences in stud spacing.

In operation, it is determined whether the removable shoe should be installed in the assembled Portajack. The base is temporarily attached to the associated subfloor or joist, and the ram pusher is urged against the flooring element to be installed, and to force the flooring element into engagement with the adjacent element and to hold it in the proper position for fixing into place. The fixing or attachment means can be nails, screws, or adhesive. The process is then repeated until the floor is completed. The invention is particularly useful for installing wooden strip flooring which is slightly crooked or warped, or which is curved or bent.

SUMMARY OF THE ACHIEVEMENT OF THE OBJECTS OF THE INVENTION

From the foregoing, it is readily apparent that I have invented an improved method and apparatus for installing wooden flooring, particularly where a flooring strip is curved, bent, warped, or crooked, and urging it into engagement with an adjacent flooring member, as well as providing apparatus for installing a flooring strip which is capable of both pushing and pulling the strip into position for nailing.

It is to be understood that the foregoing description and specific embodiments are merely illustrative of the best mode of the invention and the principles thereof, and that various modifications and additions may be made to the apparatus by those skilled in the art, without departing from the spirit and scope of this invention, which is therefore understood to be limited only by the scope of the appended claims.

What is claimed is:

1. A tool for use when putting down floor elements, primarily with groove and tongue joints, comprising:

a base plate having holes therethrough for attachment to a support;

a rack and pinion gear housing affixed to said base plate, the rack housing having an associated pinion gear with levering handle and the gear being in communication with a rack, the rack having a ram pusher at the end thereof; and, the end of the base plate adjacent the ram pusher being provided with a removable shoe.

2. A tool according to claim 1 wherein said ram pusher is an angle iron affixed to the end of said rack.

3. A tool according to claim 1 wherein said base is provided with a downwardly opening recess adapted to receive said removable shoe.

4. A tool according to claim 3, further comprising means for retaining said removable shoe in said recess.

5. A tool according to claim 4 wherein said retaining means are machined screws inserted through hole in said base into mating holes in said removable shoe.

6. A tool according to claim 2 wherein said ram pusher is provided with means for attaching an extension thereto for spreading the load to be applied thereto.

7. A method of installing flooring strips on a subflooring or joist, comprising:

providing a Portajack flooring tool, having a base plate with holes therethrough for attachment to a support; a rack and pinion gear housing affixed to said base plate, the rack housing having an associated pinion gear with levering handle and the gear being in communication with a rack, the rack having a ram pusher at the end thereof; and, the end of the base plate adjacent the ram pusher being provided with a removable shoe;

placing and fixing a first flooring strip in a desired position;

positioning a second flooring strip for installation;

positioning a Portajack footing tool with the ram pusher against the second strip, and nailing the tool into position to the subflooring or joist by inserting nails through the holes provided in the base plate;

urging the second strip into engagement with the first strip by activating the rack and pinion gear of the tool; and, fixing the second strip firmly into position.

8. A method according to claim 7, wherein said fixing is accomplished by driving nails or screws, or by utilizing adhesive.

* * * * *